US009775389B2

(12) United States Patent
Azzolin et al.

(10) Patent No.: US 9,775,389 B2
(45) Date of Patent: Oct. 3, 2017

(54) PERSONAL PROTECTION DEVICE

(71) Applicant: DAINESE S.P.A., Molvena (IT)

(72) Inventors: Andrea Azzolin, Molvena (IT); Marcello Bencini, Molvena (IT)

(73) Assignee: DAINESE S.P.A., Molvena (IT)

( * ) Notice: Subject to any disclaimer, the term of this patent is extended or adjusted under 35 U.S.C. 154(b) by 0 days.

(21) Appl. No.: 14/888,411

(22) PCT Filed: Jun. 11, 2014

(86) PCT No.: PCT/IB2014/062125
§ 371 (c)(1),
(2) Date: Oct. 30, 2015

(87) PCT Pub. No.: WO2014/199309
PCT Pub. Date: Dec. 18, 2014

(65) Prior Publication Data

US 2016/0088883 A1 Mar. 31, 2016

(30) Foreign Application Priority Data

Jun. 12, 2013 (IT) ..... VR2013A0136

(51) Int. Cl.
*D03D 15/12* (2006.01)
*A41D 13/018* (2006.01)
(Continued)

(52) U.S. Cl.
CPC ..... *A41D 13/018* (2013.01); *A41D 1/04* (2013.01); *A62B 17/003* (2013.01); *D03D 15/12* (2013.01)

(58) Field of Classification Search
CPC ..... A41D 13/015; A41D 13/018; A41F 1/00; A41B 1/08; A42B 1/203
(Continued)

(56) References Cited

U.S. PATENT DOCUMENTS 1,158,312 A 10/1915 Schwartz
2,535,874 A 12/1950 Starn
(Continued)

FOREIGN PATENT DOCUMENTS

IT WO 2008044222 A2 * 4/2008 ..... A41D 13/018
JP 11124087 5/1999
(Continued)

OTHER PUBLICATIONS

International Search Report mailed on Oct. 15, 2014 for PCT/IB2014/062125 filed on Jun. 11, 2014 in the name of Dainese S.P.A.
(Continued)

*Primary Examiner* — Tejash Patel
(74) *Attorney, Agent, or Firm* — Steinfl + Bruno LLP

(57) ABSTRACT

A personal protection device for the protection of a portion of the body of a user is described. The device has an inflatable member intended to protect at least partially a zone of the body of a user. The personal protection device includes at least a first portion and a second portion. The first portion and the second portion are superimposed in a corresponding overlapping area or superimposition area. In the personal protection device the height or thickness of at least one, or each, of the first portion and the second portion is, in the overlapping area or superimposition area, smaller than the height or thickness of a remaining part of the inflatable member.

19 Claims, 4 Drawing Sheets

(51) Int. Cl.
*A62B 17/00* (2006.01)
*A41D 1/04* (2006.01)

(58) Field of Classification Search
USPC ..... 2/455, 94, 96, 102, 108, 121, 171, 2/DIG. 3, DIG. 10
See application file for complete search history.

(56) References Cited

U.S. PATENT DOCUMENTS

| | | | | |
|---|---|---|---|---|
| 3,102,570 | A * | 9/1963 | Fairchilds | A44B 19/32 2/96 |
| 3,441,963 | A | 5/1969 | Steinthal | |
| 3,827,716 | A | 8/1974 | Vaughn et al. | |
| 3,931,657 | A | 1/1976 | Jones | |
| 4,236,264 | A | 12/1980 | Britzman | |
| 4,324,005 | A * | 4/1982 | Willis | A42B 3/0486 2/413 |
| 4,416,641 | A | 11/1983 | Spinosa et al. | |
| 4,523,914 | A | 6/1985 | Faulconer et al. | |
| 4,547,919 | A * | 10/1985 | Wang | A42B 3/122 2/18 |
| 4,825,469 | A | 5/1989 | Kincheloe | |
| 4,837,859 | A | 6/1989 | Hamberg | |
| 4,984,821 | A | 1/1991 | Kim et al. | |
| 5,046,894 | A | 9/1991 | Bergstrom | |
| 5,197,149 | A | 3/1993 | Overton | |
| 5,243,706 | A | 9/1993 | Frim et al. | |
| 5,402,535 | A | 4/1995 | Green | |
| 5,435,009 | A * | 7/1995 | Schild | A61F 5/0195 128/DIG. 20 |
| 5,500,952 | A | 3/1996 | Keyes | |
| 5,567,191 | A | 10/1996 | Gordon | |
| 5,617,580 | A | 4/1997 | DiCesare et al. | |
| 5,746,442 | A | 5/1998 | Hoyaukin | |
| 5,759,076 | A | 6/1998 | Bateman et al. | |
| 5,781,936 | A | 7/1998 | Alaloof | |
| 5,797,143 | A | 8/1998 | Buxton | |
| 5,867,842 | A | 2/1999 | Pinsley et al. | |
| 6,035,452 | A | 3/2000 | Braxton | |
| 6,098,208 | A | 8/2000 | Cordon | |
| 6,125,478 | A | 10/2000 | Alaloof | |
| 6,156,000 | A | 12/2000 | Chen et al. | |
| 6,182,288 | B1 | 2/2001 | Kibbee | |
| 6,209,145 | B1 | 4/2001 | Tillett | |
| 6,230,333 | B1 * | 5/2001 | Umeda | A41D 13/0125 2/463 |
| 6,317,887 | B1 * | 11/2001 | Gattamorta | A61F 9/045 2/12 |
| 6,546,561 | B2 | 4/2003 | Duhamell | |
| 6,722,819 | B2 | 4/2004 | Godoy | |
| 6,766,535 | B2 | 7/2004 | Duhamell et al. | |
| 6,966,809 | B2 | 11/2005 | Urabe | |
| 7,028,341 | B2 | 4/2006 | Ikenaga et al. | |
| 7,309,304 | B2 | 12/2007 | Stewart et al. | |
| 7,370,370 | B2 | 5/2008 | Colombo | |
| D585,603 | S | 1/2009 | O'Connor et al. | |
| 7,484,751 | B2 | 2/2009 | Goto | |
| 7,574,755 | B1 | 8/2009 | Alston | |
| 7,815,584 | B2 | 10/2010 | Stewart, III | |
| 7,841,344 | B2 | 11/2010 | Schlosser | |
| 7,849,519 | B2 | 12/2010 | Goto | |
| 8,402,568 | B2 | 3/2013 | Alstin et al. | |
| 8,595,864 | B2 | 12/2013 | Orita et al. | |
| 9,027,170 | B2 | 5/2015 | Dainese et al. | |
| 9,332,794 | B2 | 5/2016 | Mazzarolo et al. | |
| D767,825 | S | 9/2016 | Georgeson et al. | |
| 9,439,460 | B2 | 9/2016 | Richards | |
| 2003/0196256 | A1 | 10/2003 | Drake | |
| 2004/0033739 | A1 | 2/2004 | Courtney | |
| 2006/0175810 | A1 | 8/2006 | Goto | |
| 2006/0288464 | A1 | 12/2006 | Warden | |
| 2007/0118952 | A1 | 5/2007 | Lee | |
| 2008/0178370 | A1 | 7/2008 | Orita et al. | |
| 2008/0235854 | A1 | 10/2008 | Orita et al. | |
| 2012/0032422 | A1 | 2/2012 | Dainese et al. | |
| 2013/0185853 | A1 | 7/2013 | Ricart et al. | |
| 2014/0047623 | A1 | 2/2014 | Richards | |
| 2014/0352042 | A1 | 12/2014 | Celi | |
| 2015/0040286 | A1 | 2/2015 | Schultz et al. | |
| 2015/0238124 | A1 | 8/2015 | Buckman | |
| 2016/0073707 | A1 | 3/2016 | Ronco | |
| 2016/0073708 | A1 | 3/2016 | Richards | |
| 2016/0088883 | A1 | 3/2016 | Azzolin et al. | |
| 2016/0169630 | A1 | 6/2016 | Augustine et al. | |

FOREIGN PATENT DOCUMENTS

| | | |
|---|---|---|
| JP | 2007/308818 | 11/2007 |
| WO | 2009/047733 | 4/2009 |
| WO | 2010/067288 | 6/2010 |
| WO | 2010-067393 | 6/2010 |

OTHER PUBLICATIONS

Written Opinion mailed on Oct. 15, 2014 for PCT/IB2014/062125 filed on Jun. 11, 2014 in the name of Dainese S.P.A.
International Search Report issued for International Application No. PCT/IB2014/061204 filed on May 5, 2014 in the name of Dainese S.P.A.. Mail date: Aug. 19, 2014.
International Search Report issued for International Application No. PCT/IB2014/062123 filed on Jun. 11, 2014 in the name of Dainese S.P.A. Mail date: Nov. 6, 2014.
Written Opinion of the International Searching Authority issued for International Application No. PCT/IB2014/062123 filed on Jun. 11, 2014 in the name of Dainese S.P.A. Mail date: Nov. 6, 2014.
Restriction Requirement for U.S. Appl. No. 14/785,619, filed Oct. 19, 2015 on behalf of Luigi Ronco. Mail Date: Mar. 1, 2017. 10 pages.
Non-Final Office Action for U.S. Appl. No. 14/888,067, filed Oct. 29, 2015 on behalf of Andrea Azzolin. Mail Date: Dec. 14, 2016. 18 pages.

* cited by examiner

PERSONAL PROTECTION DEVICE

CROSS REFERENCE TO RELATED APPLICATIONS

The present application is the US national stage of International Patent Application PCT/IB2014/062125 filed on Jun. 11, 2014, which, in turn, claims priority to Italian Patent Application VR2013A000136 filed on Jun. 12, 2013.

The present disclosure relates to a protection device for personal protection including an inflatable member adapted to protect from impacts and/or falls a passenger or a rider of a motorcycle or a horse-racing rider or a similar user, during a sporting and/or working activity.

During recent years, following constant research into safety during all sporting activities, but more generally all those dangerous activities practiced in extreme conditions, or at high speeds, in particular in the motorcycle sector, there has been an increase in the protection devices which have been developed with a view to providing both practical and effective protection of an upper portion of a user's body, using an inflatable member. During an impact, a sliding action or generally a fall, the inflatable bag is placed in fluid communication with a fluid source, such as a compressed-gas cylinder or a fluid generator.

During an impact, the inflatable element creates an air cushion around the upper portion of the user's body, allowing the user's body to be protected against impacts. The present disclosure is based on a recognition by the inventor of the present patent application that the inflatable bag has normally a shape or form which is similar to that of a vest or waistcoat so that it may be easily worn by a user or so that it may be associated with a garment. As a result the bag has, like a normal jacket, superficial discontinuities or interruptions, for example in a middle region of the chest. In these zones, the bag may be closed by means of a zip associated directly with the bag, or may be kept closed by the zip, or other closing device, of the jacket.

Other zones where there are superficial discontinuities or interruptions are, for example, those situated underneath the armpits along the sides. These superficial discontinuities or interruptions, however, represent vulnerable zones for protection of a user, precisely because the protection is not continuous. Moreover, in particular the zones of the chest and sides are so-called vital zones for a user since they are zones via which, if there is not suitable protection, the vital organs may be reached.

As a result the similarity in terms of form and shape of the inflatable bag with a vest or waistcoat, if on the one hand it results in the inflatable bag being easier to wear, on the other hand it may have a negative impact on the protective capacity of the inflatable bag, owing to superficial interruptions or discontinuities.

Moreover, the inventor of the present disclosure has realized that, in some bags, in order to avoid superficial interruptions on the chest and allow positioning of a bag completely in front of the chest, it is necessary to displace the zone of the superficial discontinuity or interruption onto one side of the chest, towards the shoulder.

Basically, the bag is continuous on the chest and has an interruption on one side, namely no longer in the center of the chest, which allows the bag to be opened and worn. A zip is also provided in the interruption zone.

The positioning of the zip in a side zone, however, results in a user having to operate the zip in this side zone which is zone situated off-center and is therefore less accessible.

This displacement to one side may also have an impact or effect, which is not always positive, on the wearability of garments associated with these bags, since zips for opening the garment are provided in the shoulder zone, and also on the general appearance of the garment which may not be liked by a large number of users.

Based on these realizations, a technical problem forming the basis of the present disclosure is that of providing a protection device which is able to ensure continuous superficial protection, while ensuring at the same time satisfactory wearability by the user.

In order to solve this technical problem, a personal protection device is provided, having the main characteristic features which are respectively specified in claim 1, together with a garment according to claim 16 and a method for protecting a user according to claim 17.

Secondary characteristic features forming the subject of the present disclosure are defined in the corresponding dependent claims.

In particular, in accordance with the present disclosure, in order to avoid superficial interruptions, a personal protection device is provided where the inflatable member includes at least two inflatable member portions which are superimposed in a corresponding overlapping or superimposition area.

In order to limit the overall volume and ensure the wearability of the inflatable member, the height of at least one or each of the two superimposed portions of the inflatable member is, in the overlapping area, smaller than the height of the remaining part of the personal protection device so as to ensure a substantial uniform height of the entire personal protection device, irrespective of the superimposed arrangement, and therefore limit the overall volume.

As a result, according to the present disclosure, in order to avoid superficial discontinuities, two portions of a same inflatable member or of two inflatable members having a smaller height or thickness than a remaining part of the personal protection device are superimposed. These inflatable member portions may be terminal or end portions facing each other when the inflatable member is worn.

Overlapping may be performed in any user protection zone where discontinuities exist in the inflatable member, or discontinuities are envisaged, such as to obtain protection of the user which is as continuous and complete as possible.

The two inflatable member portions may be superimposed, for example, on the chest of a user, so as to allow convenient central opening/closing of the protection device. The two inflatable member portions may also be superimposed, for example, on the sides of a user, or in another part of the body.

In one embodiment, in order to keep the two inflatable member portions fixed in the superimposed position, the personal protection device includes a connecting device or structure associated with the two inflatable member portions in the superimposition area. The connecting device or structure may be a reversible connecting structure, namely a structure which may be opened or closed as required, and may also be an adjustable connecting structure, namely a structure which may allow superimposition or overlapping of the two portions to be adjusted. For example, in some embodiments, the connecting structure includes a zip structure, a string or lace structure, optionally with Velcro, a structure with buckles and ties, or similar structures.

As a result, in accordance with some embodiments of the present disclosure, each inflatable member portion of smaller height is associated with the connecting or closing structure so as to ensure stable closure of the two portions of the inflatable member, for example of the two terminal or end portions.

In one embodiment of the present disclosure, the connecting and closing structure comprises two flaps or panels made of soft material, such as fabric. Each of the two flaps is fixed, for example stitched or glued to one of the two inflatable member portions in a zone adjacent to the superimposition or overlapping area. In this way, when the two inflatable member portions are superimposed, the two flaps are situated close and may be connected together. The two flaps may be fixed to the inflatable member in an intermediate zone between the overlapping area and a non-overlapping area of the inflatable member.

The two flaps may be pieces or panels of cloth or fabric which extend along the inflatable member portions. These flaps may be provided with a zip portion or other connecting device of the type which can be opened or reversed, such as Velcro. In particular, a zip portion associated with a flap is connected in a reversible or temporary manner to a complementary zip portion associated with the other flap. Similarly a Velcro portion associated with one flap and a complementary portion of Velcro associated with the other flap may be connected together.

In one embodiment of the present disclosure the flaps may be also be provided with elastic inserts or be made of elastic material, so as to allow adjustment of the dimensions of the personal protection device to the body of the user at the moment of inflation. In particular, when inflation occurs, the two superimposed portions of the inflatable member move away momentarily from each other with a reduction in mutual overlapping. At the end of an inflation condition, the elastic means return into an original condition such that the two inflatable member portions move back towards each other again.

In one embodiment, as mentioned above, the connecting structure includes one or more strips of cloth or fabric, a string or similar member, associated with one of the inflatable member portions and a ring, a buckle or similar fastening member associated with the other one of the inflatable member portions. The strip or string is connected to the buckle or similar fastening member in a reversible manner, so as to connect together the two inflatable member portions.

The inflatable member described above may be easily incorporated inside a garment, for example inside respective pockets of a garment. The garment may be structured so as to have pockets which are superimposed like the inflatable member, and fabric flaps which are joined together. Alternatively, the inflatable member portions which are superimposed may protrude from the pockets of the garment.

In one embodiment, the inflatable member may be lined externally, or covered, with a fabric suitable for clothing, and assume the appearance of a garment which may be worn on its own.

Further characteristic features and modes of use forming the subject of the present disclosure will become clear from the following detailed description of a number of preferred examples of embodiment thereof, provided by way of a non-limiting example. It is evident, however, that each example of embodiment may have one or more of the advantages listed above; in any case it is not required that each embodiment should have simultaneously all the advantages listed.

Reference will be made to the figures of the accompanying drawings in which.

Figure 2:
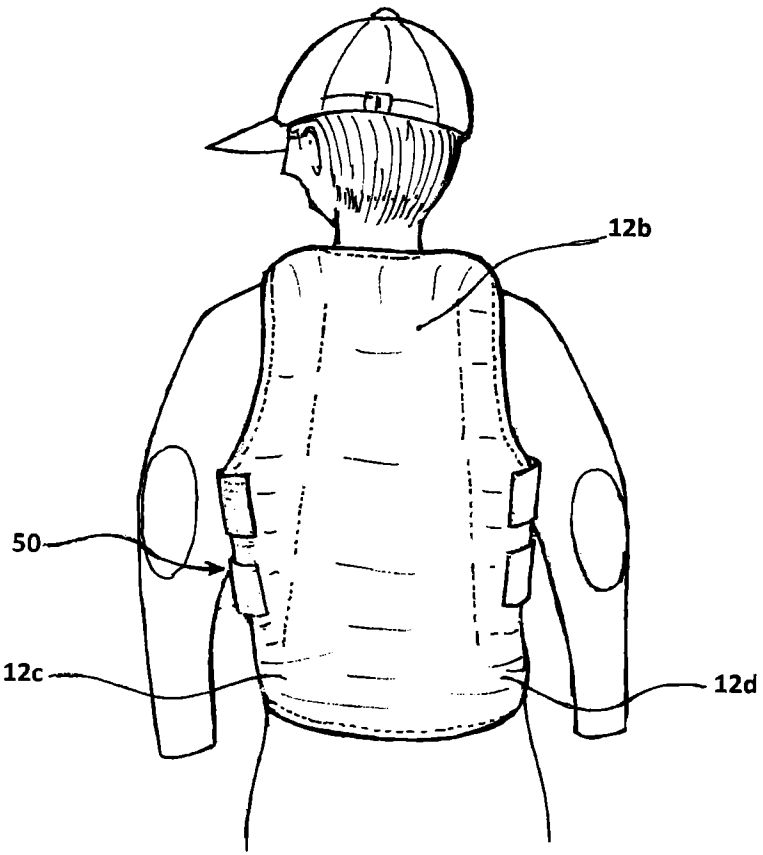
FIG. 2 shows a rear view of a protection device according to an embodiment of the present disclosure, in a condition where worn.
Figure 1:
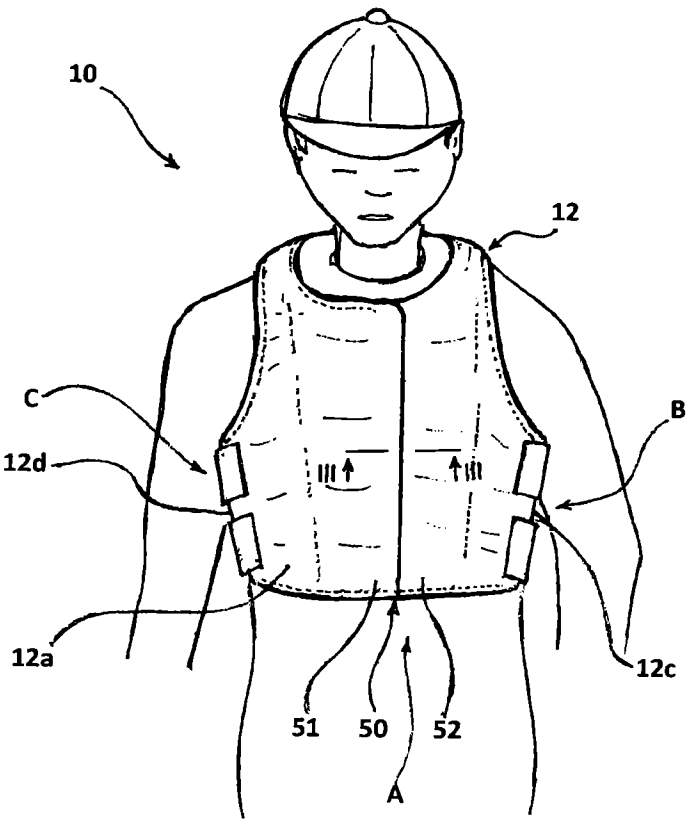
FIG. 1 shows a front view of a protection device according to an embodiment of the present disclosure, in a condition where worn.

With reference to the accompanying figures, the reference number 10 indicates a personal protection device according to the present disclosure in accordance with an embodiment of the present disclosure.

The personal protection device 10 comprises an inflatable member 12 which is adapted to assume substantially a first rest condition or deflated condition, and a second active condition or inflated condition. The modes for inflating the inflatable member 12 will be described in the description below.

In one embodiment of the present disclosure the inflatable element 12 is in the form of a vest and is adapted to surround a top or chest zone of a user's body. In particular, the inflatable member 12 includes a chest zone 12*a*, a back zone 12*b* and a side zone 12*c*, 12*d*. The zones 12*a*, 12*b*, 12*c*, 12*d* are connected together in fluid communication via the shoulders.

The inflatable member 12 may be made using the technology described in patent application PCT/IB2009/055512 and in patent application PCT/IT2009/000547, which are cited fully here in the present disclosure by way of reference source.

The inflatable member 12 includes a first inflatable member portion 20, 30, 40 and a second inflatable member portion 21, 31, 41. This first inflatable member portion 20, 30, 40 and second inflatable member portion 21, 31, 41 are terminal or end portions of the inflatable member 12 and are partially superimposed. In other words, the first inflatable member portion 20, 30, 40 and this second portion 21, 31, 41 of the inflatable member 12 are portions arranged at the free ends of the inflatable member 12

Even more particularly, in one embodiment of the present disclosure such as that illustrated in the figures, three superimposition areas, indicated by the reference letters A, B, C, are provided. A first superimposition area A corresponds to a central zone of the chest. A second superimposition area B corresponds to a first side zone of the user. A third superimposition area C corresponds to a second side zone of the user. It is to be understood that a single superimposition area may be provided in the chest zone or the side zone or in another zone of the user's body.

Consequently, in an embodiment of the present disclosure such as that shown in the figures, the first portion 20 and the second portion 21 of the inflatable member 12 are end portions situated in the chest region of a user. The first portion 30 and the second portion 31 of the inflatable member are end portions situated along a first side of a user. The first portion 40 and the second portion 41 of the inflatable member are end portions situated along a second side of a user.

A remaining part of the inflatable member 12 which does not have superimposed or overlapped zones is adjacent to the overlapping area A, B, C and is indicated generally by the reference number 18. As a result the inflatable member 12 also covers substantially the entire torso without superficial discontinuities.

Figure 3:
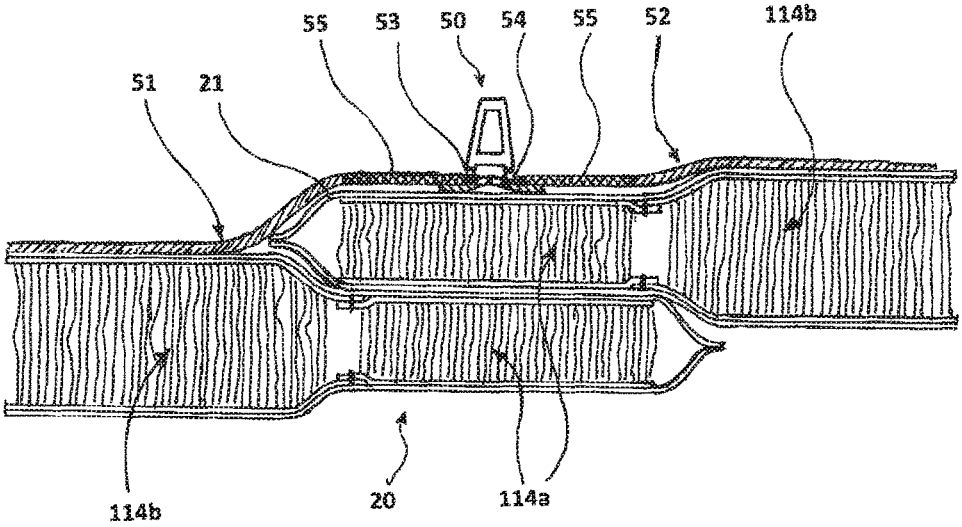
FIG. 3 shows a cross-sectional view along the line III-III of the protection device according to FIG. 1.
Figure 4:
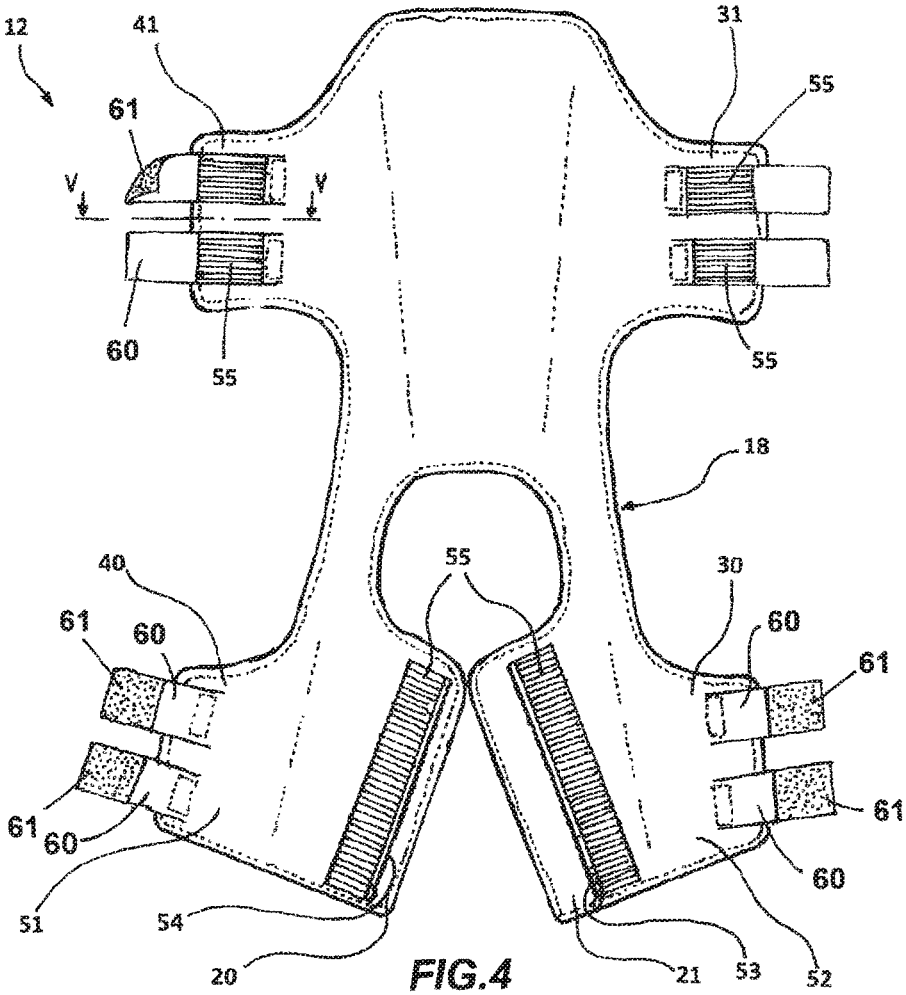
FIG. 4 shows a top plan view of a protection device according to an embodiment of the present disclosure, in an extended condition on a surface.
Figure 7:
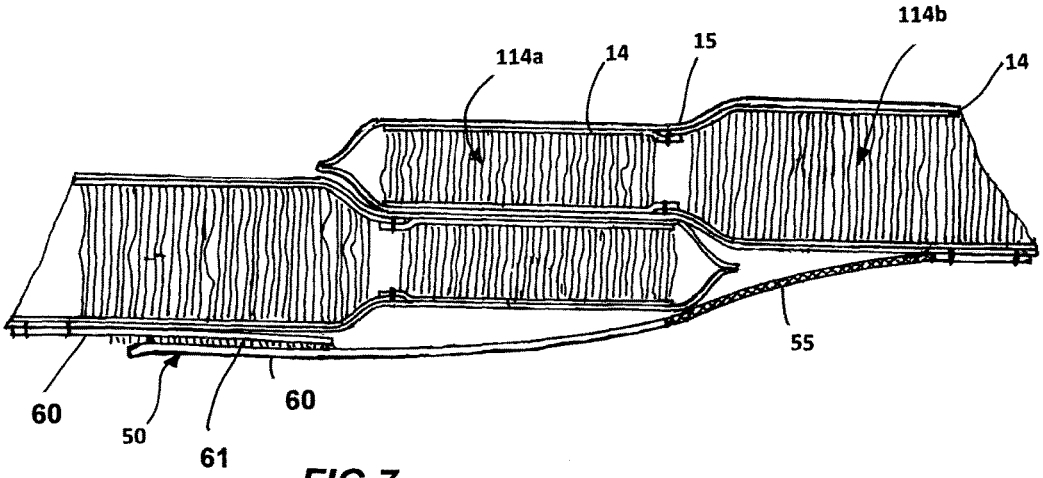
FIG. 7 shows a cross-sectional view along the line VII-VII of the protection device according to FIG. 6.
Figure 9:
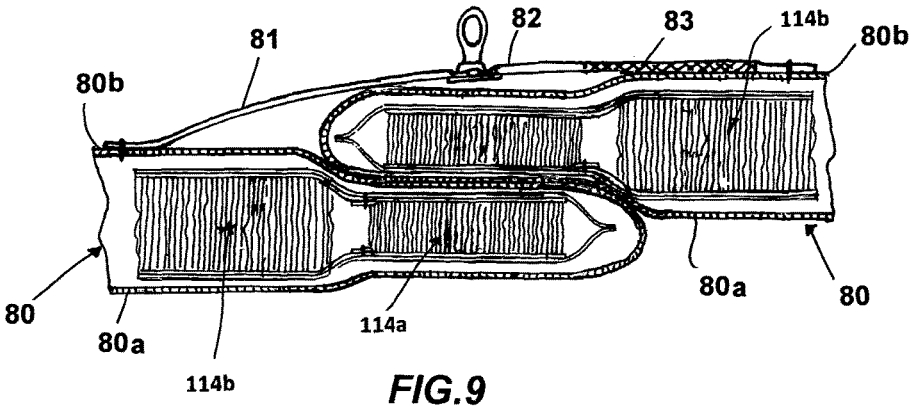
FIG. 9 shows a cross-sectional view along the line IX-IX of the protection device according to FIG. 8.

According to at least one aspect of the present disclosure, the height or thickness of at least one or each of the first portion 20, 30, 40 of the inflatable member and the second portion 21, 31, 41 of the inflatable member is, in the overlapping area, smaller than the height or thickness of the remaining part of the personal protection device so as to ensure a substantially uniform height of the entire personal protection device (as can be seen in FIG. 3, FIG. 7 and FIG. 9), independently of the overlapping, and therefore limit the overall volume. The different height is obtained using textile structures with threads of different height, as described in the patent application PCT/IB2009/055512 and the patent application PCT/IT2009/000547 which are mentioned above.

More particularly, in accordance with said technology, the inflatable member has a height/thickness which can be determined beforehand. In fact, the inflatable member 12 comprises a plurality of tie members 13, in the example threads, which are indicated diagrammatically in FIG. 3 and FIG. 5 and are distributed inside the inflatable member 12, said tie members 13 being stably connected to opposite surface portions of the inflatable member 12.

Said tie members 13 have in particular a length such that, when the inflatable member 12 is in the deflated rest condition, the tie members 13 are in a non-tensioned condition and are collapsed inside the inflatable member 12, whereas, when the inflatable member 12 is in the inflated condition, the tie members 13 are subjected to tensile stress. More particularly, the tie members 13 are connected to respective meshes 14 which are lined or covered externally by sheets or walls 15. In practice, the inflatable member 12 includes a first sheet 15 or first wall, to which a first mesh 14 is adheringly fixed, and a second sheet 15, or second wall, to which a second mesh is adheringly fixed, wherein said meshes 14 are connected together by means of the plurality of tie members 13. The two sheets 15 are situated opposite each other and are perimetrally connected in a sealed manner along respective perimetral edges.

The height of the inflatable member 12 can be adjusted by suitably setting the maximum distance which can be obtained between the meshes 14 with a maximum longitudinal extension of the tie members. Essentially, the inflatable member 12 has a height which can be determined beforehand, since the maximum expansion of the inflatable member can be controlled by controlling the length and the maximum tension of the tie members.

As a result, in order to obtain an inflatable member having portions of different heights, it is possible to use two structures 114*a*, 114*b* (formed by meshes 14 and tie members 13 of suitable height) where the length is chosen so as to determine a maximum mutual distance between the meshes 14 corresponding to a maximum local expansion of the respective inflatable member in the inflated condition. Basically two textile structures 114*a*, 11 b with tie members 13 having different lengths are used.

Figure 5:
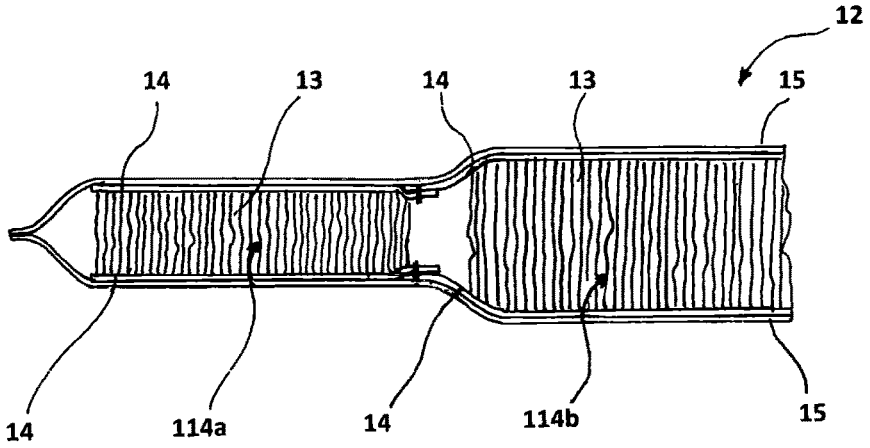
FIG. 5 shows a cross-sectional view along the line V-V of the protection device according to FIG. 4.
Figure 6:
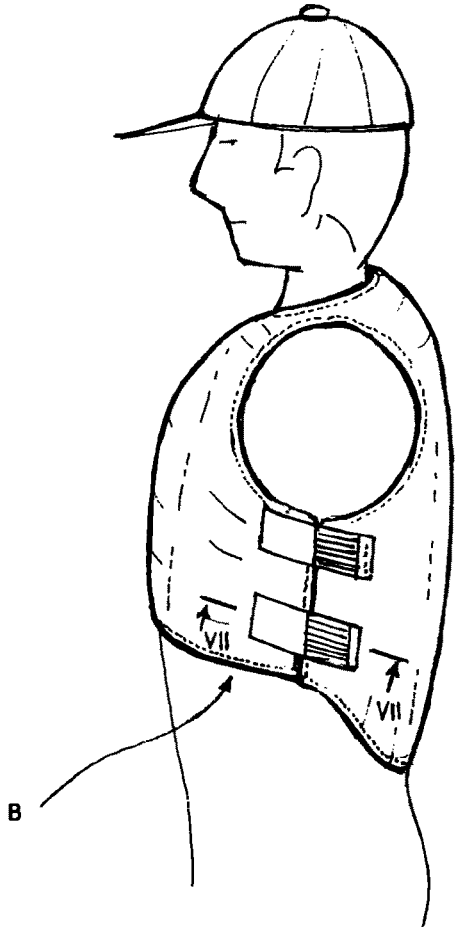
FIG. 6 shows a side view of a protection device according to an embodiment of the present disclosure, in a condition where worn.

An edge of a first mesh 14 of a textile structure 114*a* having a smaller height may be joined or stitched to a respective edge of a mesh of another textile structure 114*b* having a greater height, and similarly the edges of the respective opposite meshes 114 are stitched or joined together, as shown in FIGS. 3 and 5. In this way, the portions in which the tie members 13 have different lengths are joined together.

The meshes 14 and the tie members with different lengths are enclosed between the sheets 15 of soft material and are gas-tight, for example made of polyurethane or polyamide, having a greater surface area than the meshes 14.

In some embodiments, the smaller length of the tie members is chosen so as to obtain a portion 20, 21; 30, 31, 40, 41 of the inflatable member 12 of about 37 mm height.

The remaining part of the inflatable member 12 has instead a height of 50 mm.

In this way, in the overlapping areas A, B, C it is possible to control and limit the overall volume.

In one embodiment, such as that shown in the Figures, the personal protection device 10 includes one or more connecting and closing devices or structures 50, associated with the first portion 20, 30, 40 of the inflatable member and the second portion 21, 31, 41 of the inflatable member in the region of the superimposition area A, B, C. The connecting device or structure 50 is a zip structure, for example in the superimposition area A, and a structure with Velcro strings, straps or laces in the area B and in the superimposition area C. It is to be understood that the connecting structures 50 of the three superimposition areas may be all the same or inverted in different ways with respect to the embodiment shown in the figures.

It can be seen that one of the first inflatable member portion 20, 30, 40 and second inflatable member portion 21, 31, 41 is associated with a part of the connecting structure 50 which is connected to the complementary part of the connecting structure 50 associated with the other one of the first portion 20, 30, 40 and the second portion 21, 31, 41 so as to ensure stable closing of the first inflatable member portion 20, 30, 40 and the second inflatable member portion 21, 31, 41.

In one embodiment, such as that shown in the figures, the connecting structure 50, such as that which is situated on the user's chest, comprises two flaps or panels made of soft material 51, 52 such as fabric. Each of the two flaps 51, 52 is fixed, for example stitched or glued to one of the two portions 20, 21 of the inflatable member 12 in a zone adjacent to the superimposition or overlapping area A. These flaps may extend over the entire inflatable member 12, lining it on the outer side.

In the overlapping area A the two flaps 51 and 52 are free and movable with respect to the inflatable member 12.

In this way, when the two portions 20, 21 of the inflatable member 12 are superimposed, the two flaps 51, 52 are situated close and may be connected together. The two flaps 51, 52 may be pieces or panels of cloth or fabric which extend over an entire length of the portions 20, 21 of the inflatable member 12, so as to allow a continuous connection between the two portions 20, 21. These flaps 51, 52 may be provided at respective ends with a zip portion 53, 54 or other connecting device of the type which can be opened or reversed. A zip portion 53 associated with a flap 51 is connected in a reversible or temporary manner to a complementary zip portion 54 associated with the other flap 52.

Consequently, the two inflatable member portions 20, 21 may be superimposed, for example, on the chest of a user and the connecting structure 50 may be arranged in the centre of the chest so as to allow convenient central opening/closing of the protection device 10.

Even more particularly, the flaps 51, 52 are provided with elastic inserts 55, for example in the superimposition area A, namely where the flaps 51, 52 are freely movable. In an alternative embodiment, the flaps 51, 52 are made of a totally elastic fabric. The presence of the flaps with inserts 55 which are elastic or made of elastic fabric allows widening of the inflatable member 12 during inflation, thus preventing an increase in volume of the inflatable member from causing any constriction of the user's body. In other words, the elastic material allows adaptation of the entire inflation device of the inflatable member 12 and is also able to favor the return of the inflatable member into the deflated condition; this is possible owing to the typical properties of the elastic material which, once deformed under a deforming action (in this case caused by the inflation of the inflatable member), resumes its normal or initial configuration when the deforming action ceases.

In fact, when the inflatable member 12 is inflated, the insert is in a completely deformed condition and the overall extension of the protection device in fact increases, whereas, when the inflatable member in the deflated condition, the elastic insert returns into an undeformed or only partially deformed condition, thus also causing the entire inflatable member 12 to return into its initial condition.

It should be noted that the portions 20, 21, 30, 31, 40, 41 of the inflatable member move away from each other during inflation and, owing to the elastic material, return into the initial position.

In one embodiment, such as that shown in the figures and as already mentioned above, the connecting structure 50, such as that associated with the area B and with the superimposition area C includes a strip or strap, and more particularly in the example two pairs of fabric strips or straps 60 with a suitable resistance to tensile stress. The strips 60 are provided with Velcro sections 61 for fixing together. Each strip 60 is associated with one of the portions of the inflatable member 12 (first portion 30, 40 and second portion 31, 41). The strip or string 60 is connected by means of Velcro to the other strip by fixing together the Velcro so as to connect the first inflatable member portion 30, 40 and the second inflatable member portion 31, 41 in a reversible manner (FIG. 7). The extension of the Velcro is such as to allow the degree of overlapping to be adjusted and the fit of the protection device to be adapted to the chest of a user.

The strip 60 may also be provided with an elastic insert 55, as can be seen in FIG. 7.

As a result, the two portions 30, 31; 40, 41 of the inflatable member may be superimposed for example on the sides of a user, or on the chest, so as to allow easy central opening/closing of the protection device 10 and also adjustment of the mutual superimposition, with adaptation of the fit.

Figure 8:
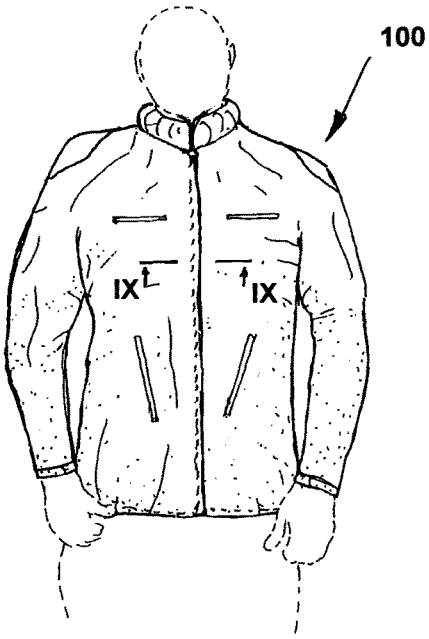
FIG. 8 shows a front view of a garment including a protection device according to an embodiment of the present disclosure.

It is also pointed out that the inflatable member 12 described above may be easily incorporated inside a garment, such as a jacket 100 (FIG. 8), for example inside respective pockets 80 of a garment.

The garment 100 may be designed with a structure having pockets 80 for containing the inflatable member 12, which are superimposed in the same way as the inflatable member. More particularly, each pocket 80 has an inner wall **80*a*** which coincides with an inner lining and an outer wall which coincides with a visible surface of the garment.

The garment includes flaps 81, 82 which are entirely comparable in terms of structure and function to the flaps 51, 52 described above and provided, where appropriate, with an elastic insert 83. The flaps 81, 82 are fixed to the outer wall **80*b*** of the pocket and are free and movable in a superimposition area, so as to allow the garment to be closed and a closed condition of the inflatable member to be maintained in the superimposition area.

Alternatively, as mentioned above, in one embodiment, the inflatable member 12 may be lined externally, or covered, with a fabric suitable for clothing, and assume the appearance of a garment which may be worn on its own.

With regard to inflation, in order to perform inflation of the inflatable element 12, in the event of a sudden fall and/or sliding and/or an impact involving a user or a vehicle being ridden/driven, the protection device 10 is adapted to cooperate with special activation means (not shown) which are operationally connected to the cylinder (not shown) containing compressed cold gas, for example helium. The cylinder may be provided with a respective shut-off valve (not shown).

Alternatively, the inflation fluid source may comprise gas generators of the pyrotechnical or other hybrid type or other types known according to the state of the art.

Opening of the shut-off valve of each inflation cylinder is preferably controlled by a control unit depending on detection of the state of the vehicle/rider system; for example said control unit may implement a system for predicting the fall which allows early identification of the fall event and a reliable prediction of this by accelerometer sensor means fixed to the vehicle (or rider) and a unit for processing the signals produced by the said sensors.

Alternatively, the device according to the present disclosure may also be applied using an activation cable connected to a vehicle ridden by a user, which cable activates inflation of the inflatable element following the movement of the user away from the vehicle, for example following a fall or a sudden impact. Use of a cable is employed in particular in the horse-riding sector.

In any case the aforementioned activation and inflation means may be integrated in the protection device according to the present invention or located on the outside thereof.

It should also be noted that the activation modes, although being an aspect of particular importance for effective operation of the device, will not be further described in greater detail since they are methods which are essentially already known to a person skilled in the art of protection of an individual from sudden impacts.

The subject-matter of the present disclosure has been described hitherto with reference to preferred embodiments thereof. It is to be understood that other embodiments relating to the same inventive idea may exist, all of these falling within the scope of protection of the claims which are attached below.

The invention claimed is:

1. A personal protection device for protection of a portion of the body of a user, said device comprising an inflatable member intended to protect at least partially a zone of the body of the user, including at least a first portion and a second portion, wherein the first portion and the second portion are superimposed in a corresponding overlapping area or superimposition area, and wherein a height or thickness of at least one, or each, of the first portion and the second portion is, in the overlapping area or superimposition area, smaller than a height or thickness of a remaining part of the inflatable member, the remaining part being a non-overlapping zone located adjacent to the overlapping area; and at least one connecting device or structure associated with the first portion and the second portion, wherein the connecting device or structure is configured to keep the first portion and second portion in overlapped condition.

2. The personal protection device according to claim 1, wherein said smaller height of at least one, or each, of the first portion and the second portion with respect to a remaining part of the inflatable member is only in the overlapping area or superimposition area.

3. The personal protection device according to claim 1, wherein the inflatable member includes two adjacent textile structures connected to each other, wherein a first textile structure is included in one, or each, of the first portion and the second portion and a second textile structure is included in the remaining part of the inflatable member and wherein a height of the first textile structure is smaller than a height of the second textile structure.

4. The personal protection device according to claim 1, wherein the remaining part of the inflatable member is a part adjacent respectively to the first portion and to the second portion.

5. The personal protection device according to claim 1, wherein the first portion and the second portion are terminal portions or end portions of the inflatable member.

6. The personal protection device according to claim 1, wherein the connecting device or structure is arranged in a middle zone of the overlapping area and wherein the connecting device or structure is a structure which allows a reversible connection between the first portion and the second portion.

7. The personal protection device according to claim 1, wherein the connecting device or structure is a zip structure or a structure with strings, straps or laces.

8. The personal protection device according to claim 6, wherein the connecting structure comprises two flaps, or panels, made of soft material, wherein one side of each of the two flaps is fixed to one of the two portions of the inflatable member and the other side is free or mobile.

9. The personal protection device according to claim 1, wherein the overlapping area is a front area of the torso of a user.

10. The personal protection device according to claim 1, wherein the overlapping area is a side area of the torso of a user.

11. The personal protection device according to claim 1, wherein the connecting structure comprises two flaps, or panels, made of soft material, wherein one side of the two flaps is, directly or indirectly, fixed or connected to one of the two portions of the inflatable member, and the other side of the two flaps, on a side facing the other of the two portions of the inflatable member, is free and mobile and adapted to be connected to the other of the two flaps associated with the other of the first portion and the second portion.

12. The personal protection device according to claim 11, wherein each of the two flaps is a cloth or fabric piece or panel which is, directly or indirectly, connected to the respective first portion or second portion in an intermediate region between the overlapping area and a remaining part of the inflatable member.

13. The personal protection device according to claim 1, wherein the connecting structure comprises elastic inserts or is made of elastic material.

14. The personal protection device according to claim 11, wherein each or one of the two flaps includes elastic inserts or is made of elastic material.

15. A garment including, or in combination with, the personal protection device according to claim 1.

16. A method for protecting a user comprising the steps of arranging an inflatable member at least partially on a region of the user's body, wherein a first portion of said inflatable member is superimposed on a second portion of the inflatable member in a corresponding overlapping area or superimposition area, and wherein a height or thickness of at least one, or each, of the first portion and the second portion is, in the overlapping area or superimposition area, smaller than a height or thickness of a remaining part of the inflatable member, the remaining part being a non-overlapping zone located adjacent to the overlapping area; and at least one connecting device or structure is associated with the first portion and the second portion, wherein the connecting device or structure is configured to keep the first portion and second portion in overlapped condition.

17. The method according to claim 16, wherein the first portion and the second portion are connected by elastic means such that, during inflation of the first portion and the second portion, the first portion and the second portion move temporarily away from each other thus decreasing a respective overlapping condition and, at the end of inflation, the elastic means return into an original condition such that the first portion and the second portion move again close to each other.

18. The personal protection device according to claim 1, wherein the first portion and the second portion are inflatable portions.

19. A personal protection device for protection of a portion of the body of a user, said device comprising an inflatable member intended to protect at least partially a zone of the body of the user, including at least a first portion and a second portion, wherein:

the first portion and the second portion are superimposed in a corresponding overlapping area or superimposition area, and a height or thickness of at least one, or each, of the first portion and the second portion is, in the overlapping area or superimposition area, smaller than a height or thickness of a remaining part of the inflatable member, the remaining part being a non-overlapping zone located adjacent to the overlapping area;

the inflatable member includes two adjacent textile structures connected to each other, a first textile structure is included in one, or each, of the first portion and the second portion and a second textile structure is included in the remaining part of the inflatable member, and a height of the first textile structure is smaller than a height of the second textile structure; and each textile structure includes pairs of opposite meshes and a plurality of tie members positioned between the meshes, the tie members having ends stably associated with surface portions of said meshes, said tie members have dimensions so that, when said inflatable member is in a deflated rest condition, said tie members are in a non-tensioned condition collapsed inside the inflatable member, and when said inflatable member is in an inflated condition, said tie members are subjected to tensile stress, and the height of the respective textile structure depends on the length of said tie members.

* * * * *